US010060109B2

(12) United States Patent
Edmonds et al.

(10) Patent No.: US 10,060,109 B2
(45) **Date of Patent: *Aug. 28, 2018**

(54) LAVATORY DRAIN

(71) Applicant: Kohler Co., Kohler, WI (US)

(72) Inventors: Cary D. Edmonds, Plymouth, WI (US); Jeffrey A. Schumacher, Port Washington, WI (US)

(73) Assignee: KOHLER CO., Kohler, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/596,242

(22) Filed: May 16, 2017

(65) Prior Publication Data

US 2017/0254057 A1 Sep. 7, 2017

Related U.S. Application Data

(63) Continuation of application No. 14/531,262, filed on Nov. 3, 2014, now Pat. No. 9,657,469.

(51) Int. Cl.
*E03C 1/22* (2006.01)
*E03C 1/23* (2006.01)

(52) U.S. Cl.
CPC ..... *E03C 1/22* (2013.01); *E03C 1/2306* (2013.01)

(58) Field of Classification Search
CPC ..... E03C 1/22; E03C 1/26; E03C 1/2306
USPC ..... 4/653, 652, 688, 290, 291
See application file for complete search history.

(56) References Cited

U.S. PATENT DOCUMENTS

| | | | |
|---|---|---|---|
| 2,143,499 A | 1/1939 | Siegmann | |
| 3,742,525 A | 7/1973 | Oropallo | |
| 4,146,939 A | 4/1979 | Izzi | |
| 5,724,684 A | 3/1998 | Paar | |
| 6,249,920 B1 | 6/2001 | McRoberts | |
| 6,381,775 B1 | 5/2002 | Sondrup | |
| 8,096,002 B2 | 1/2012 | Stimpson et al. | |
| 9,657,469 B2 * | 5/2017 | Edmonds | E03C 1/22 4/653 |

(Continued)

FOREIGN PATENT DOCUMENTS

| | | |
|---|---|---|
| CN | 201704749 | 1/2011 |
| DE | 202010007534 | 9/2010 |

(Continued)

OTHER PUBLICATIONS

Brochure—Duravit Product Name is Vero, #005024 (1 page).
Extended European Search Report dated Mar. 22, 2016 in European Patent Application No. EP15192465.1.

*Primary Examiner* — Tuan N Nguyen
(74) *Attorney, Agent, or Firm* — Foley & Lardner LLP

(57) ABSTRACT

An adjustable lavatory drain assembly includes a receptor and a cover. The receptor includes a lower end and an upper end. The upper end of the receptor includes an outer flange. The cover is removably coupled to the upper end of the receptor. The cover includes a body having an opening defining a first flow path and a sleeve extending from a bottom surface of the body. The sleeve is adjustably coupled to the upper end of the receptor forming a circumferential gap between an upper surface of the outer flange and a bottom surface of the body. The cover is selectively adjustable relative to the receptor to increase or decrease the circumferential gap. The circumferential gap defines part of a second flow path.

19 Claims, 5 Drawing Sheets

(56) References Cited

U.S. PATENT DOCUMENTS

| | | | | |
|---|---|---|---|---|
| 2006/0195976 | A1* | 9/2006 | McAlpine | E03C 1/2306 4/287 |
| 2014/0000022 | A1 | 1/2014 | McLeod | |
| 2014/0165276 | A1 | 6/2014 | Huang | |

FOREIGN PATENT DOCUMENTS

| | | |
|---|---|---|
| EP | 2041376 | 4/2009 |
| EP | 2392739 | 12/2011 |
| WO | WO2006/030180 | 3/2006 |
| WO | WO2008/009874 | 1/2008 |

* cited by examiner

LAVATORY DRAIN

CROSS-REFERENCE TO RELATED PATENT APPLICATIONS

This application is a Continuation of U.S. patent application Ser. No. 14/531,262, filed Nov. 3, 2014, the entire disclosure of which is hereby incorporated by reference herein.

BACKGROUND

Traditional lavatories, such as bathroom sinks and the like, include a vent hole that connects to a drain pipe to prevent overflow of the lavatory. The vent hole also allows for air that is present in the drain pipe to exit through the vent hole as water enters the drain. Without proper venting of the lavatory, air can become trapped between the drain opening and the trap of the drain pipe. In this situation, the water level in the lavatory basin will either rise until the water pressure above the trapped air forces the air down the drain, or the lavatory overflows.

Recently, many lavatories have been built without a vent hole for aesthetic reasons. Venting in those lavatories is typically addressed by making the openings in the drain cover very large and/or designing the drain cover to have a convex shape (i.e., a dome shape). However, the aesthetics for the drain cover are severely limited because the drain cover shape and the openings of the drain cover are dictated by the venting/draining requirements of the lavatory. Moreover, the drain openings in most drain covers are fixed. Thus, conventional drain covers are not adapted for use across multiple lavatories having different venting/draining requirements.

SUMMARY

One embodiment relates to an adjustable lavatory drain assembly. The adjustable lavatory drain assembly includes a receptor and a cover. The receptor includes a lower end and an upper end. The upper end of the receptor includes an outer flange. The cover is removably coupled to the upper end of the receptor. The cover includes a body having an opening defining a first flow path and a sleeve extending from a bottom surface of the body. The sleeve is adjustably coupled to the upper end of the receptor forming a circumferential gap between an upper surface of the outer flange and a bottom surface of the body. The cover is selectively adjustable relative to the receptor to increase or decrease the circumferential gap. The circumferential gap defines part of a second flow path.

Another embodiment relates to an adjustable drain system. The adjustable drain system includes a lavatory and a drain assembly. The drain assembly is configured to couple the lavatory to a drain pipe. The drain assembly includes a receptor and a cover. The receptor has a lower end and an upper end. The upper end of the receptor includes an outer flange. The cover is adjustably coupled to the upper end of the receptor. The cover includes a body including an opening defining a first flow path, and a sleeve extending from a bottom surface of the body. The lower end of the receptor is configured to be removably coupled to the drain pipe and a bottom surface of the flange is configured to engage the lavatory. The sleeve of the cover is coupled to the upper end of the receptor forming a circumferential gap between an upper surface of the outer flange and a bottom surface of the body. The cover is selectively adjustable relative to the receptor to increase or decrease the circumferential gap. The circumferential gap defines part of a second flow path.

Yet another embodiment relates to an adjustable drain assembly for a lavatory. The adjustable drain assembly includes a receptor and a cover. The receptor is configured to removably couple the lavatory to a drain pipe. The cover is adjustably coupled to the receptor. The cover includes an opening defining a first flow path. A portion of the cover and a portion of the receptor cooperatively define a second flow path. The cover is configured to move relative to the receptor to selectively increase or decrease a size of the second flow path.

Those reviewing the present disclosure will recognize that the various features recited above and discussed in the present application may be employed in various combinations and sub-combinations, and all such combinations and sub-combinations are within the scope of the present disclosure.

DETAILED DESCRIPTION

Figure 1:
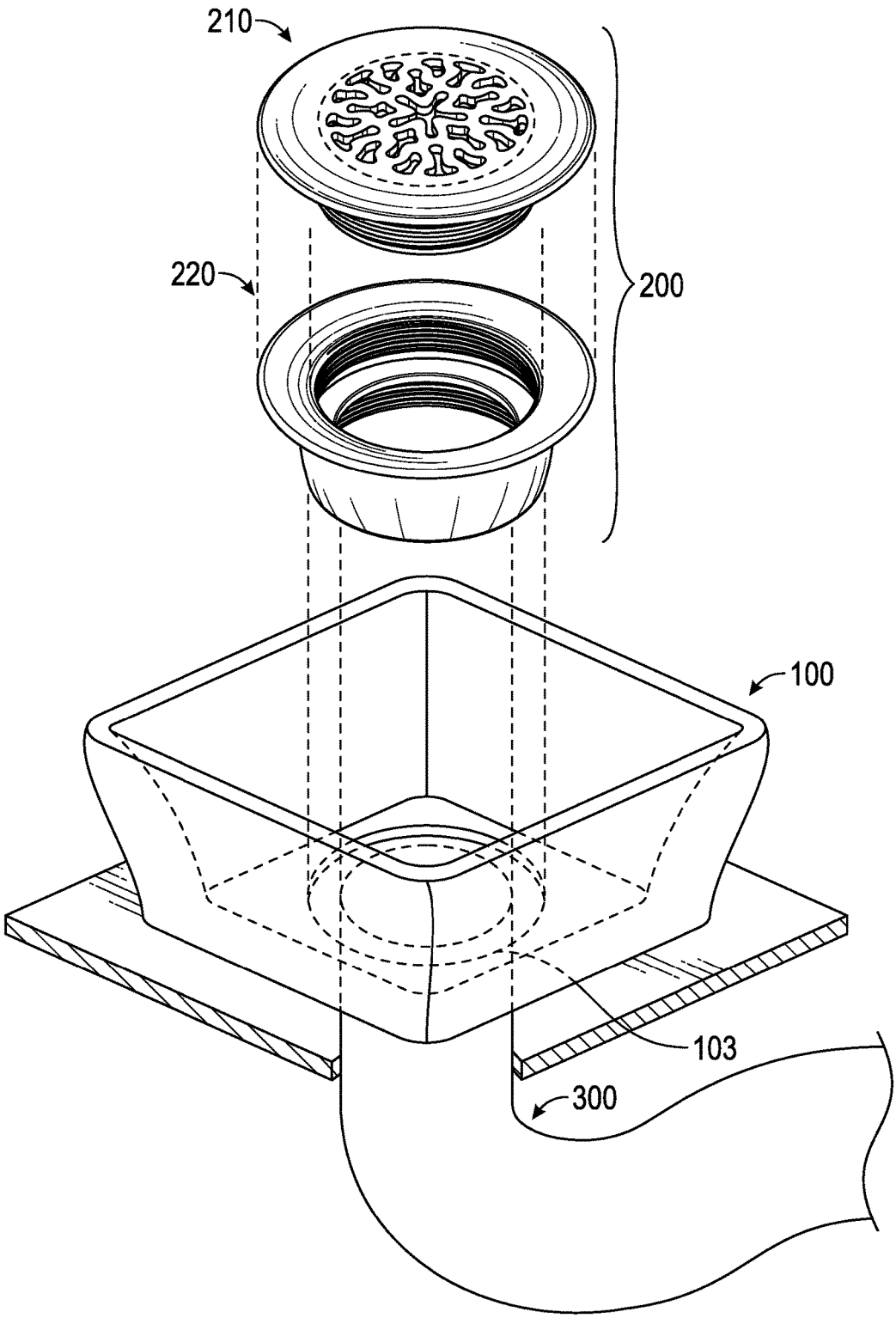
FIG. 1 is an exploded view of a lavatory including an adjustable drain assembly, according to an exemplary embodiment.

Referring generally to the FIGURES, disclosed herein are lavatory drains that are selectively adjustable such that a single drain can be used across multiple lavatories, such as lavatories without vent holes (i.e., ventless lavatories). The lavatory drain is adjustable to vary the amount of fluid flowing between the lavatory and a drain pipe such that the drain can adapt to the specific venting and draining requirements of a particular lavatory. In this way, the adjustable drain can prevent air from being trapped in the drain pipe and water from subsequently overflowing from the lavatory. This adjustable aspect also permits the drain to be adaptable for use in a wide variety of lavatories having different flow dynamics and different faucet configurations. Additionally, the adjustable drain allows for significant variations in the design (e.g., shape, size, etc.) of the drain cover and the drain openings to provide for aesthetic variations of the lavatory.

According to an exemplary embodiment, the lavatory includes a drain assembly having a cover and a receptor. The receptor is configured to couple the lavatory to a drain pipe and the cover is removably coupled to the receptor. The cover includes at least one opening located in an upper surface of the cover defining a first flow path for directing a flow of fluid (e.g., water, air, etc.) between the lavatory and the drain pipe. The cover also includes a plurality of circumferential openings arranged along a peripheral surface of the cover. The cover is disposed above the receptor such that there is a circumferential gap between the receptor and the cover. The circumferential gap and the circumferential openings collectively define a second flow path for directing a flow of fluid to/from the lavatory. The cover is selectively adjustable relative to the receptor to vary the size of the circumferential gap between the cover and the receptor, to thereby increase or decrease an amount of fluid flowing through the second flow path.

In this manner, the drain assembly can be selectively adjusted to vary the amount of venting/draining of the lavatory to thereby prevent air from being trapped in the drain pipe and water from subsequently overflowing from the lavatory. This adjustable aspect permits the drain assembly to be adaptable for use in a wide variety of lavatories having different flow dynamics and different faucet configurations. For example, the adjustable drain assembly can be used in lavatories having a water discharge stream that is directed toward the top of the cover or in lavatories having a water stream that is discharged along the wall of the lavatory. Furthermore, the configuration of the drain cover and the opening in the drain cover defining the first flow path are not dictated by the venting or draining requirements of the lavatory. Thus, the drain cover can have numerous different design configurations to allow for significant variations in the overall aesthetics of the lavatory. For example, the size of the openings in the drain cover can be sufficiently small to prevent unintended items (e.g., jewelry, personal effects, etc.) from entering the drain and still accommodate the flow of both air and water through the drain, thereby increasing functionality and aesthetic freedom.

Referring to FIG. 1, a lavatory 100 including an adjustable drain assembly 200 is shown, according to an exemplary embodiment. As shown in FIG. 1, the lavatory 100 is a bathroom sink without a vent hole (i.e., a ventless sink). However, in other exemplary embodiments, the lavatory 100 can be another type of vessel or basin, such as a kitchen sink, a utility sink, a tub, or the other similar type of vessel for receiving a fluid. The lavatory 100 is shown coupled to a fixed structural member, such as a countertop (e.g., a bathroom countertop, a table top, etc.). According to other exemplary embodiments, the lavatory 100 may be coupled to a fixed portion of a building, such as a wall, a floor, or another type of structural member suitable for supporting the lavatory 100.

As shown in FIG. 1, the lavatory 100 is in fluidic communication with a drain pipe 300 disposed below the lavatory 100. The drain pipe 300 includes a free end positioned within a drain opening 103 of the lavatory 100. The drain pipe 300 is configured to direct a flow of fluid (e.g., water, air, etc.) from the lavatory 100 to a sewage or drainage system. The drain pipe 300 is also configured to direct a flow of air from the drain pipe 300 to ambient through the opening of the drain pipe 300 for venting. For example, a volume of air that is trapped within the drain pipe 300 can be directed through the opening of the drain pipe 300 and the drain opening 103 to the area surrounding the lavatory 100.

Figure 2:
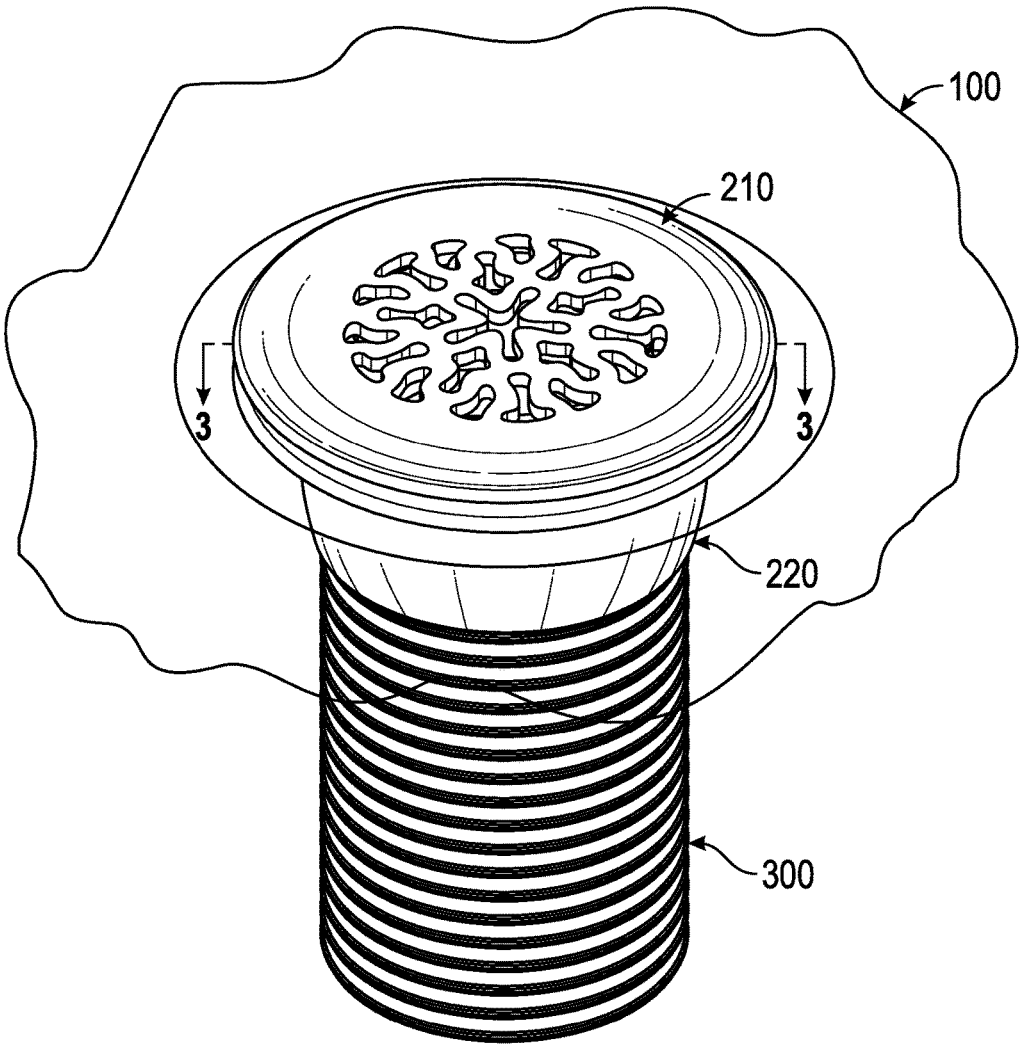
FIG. 2 is a perspective view of the adjustable drain assembly of FIG. 1, according to an exemplary embodiment.

An adjustable drain assembly 200 is configured to couple the lavatory 100 to the drain pipe 300. The adjustable drain assembly 200 is also configured to control the draining of the lavatory 100 and to control the venting of the drain pipe 300. According to the exemplary embodiment of FIG. 1, the drain assembly 200 includes a cover 210 and a receptor 220. The receptor 220 is configured to couple the lavatory 100 to the drain pipe 300 (see FIG. 2). The cover 210 is adjustably coupled to the receptor 220, as shown in FIG. 2. When the cover 210 is coupled to the receptor 220, the opening of the drain pipe 300 and the receptor are concealed from view within the lavatory 100. In this way, the cover 210 appears seamless in the basin of the lavatory 100 to a user looking into the lavatory.

Figure 3:
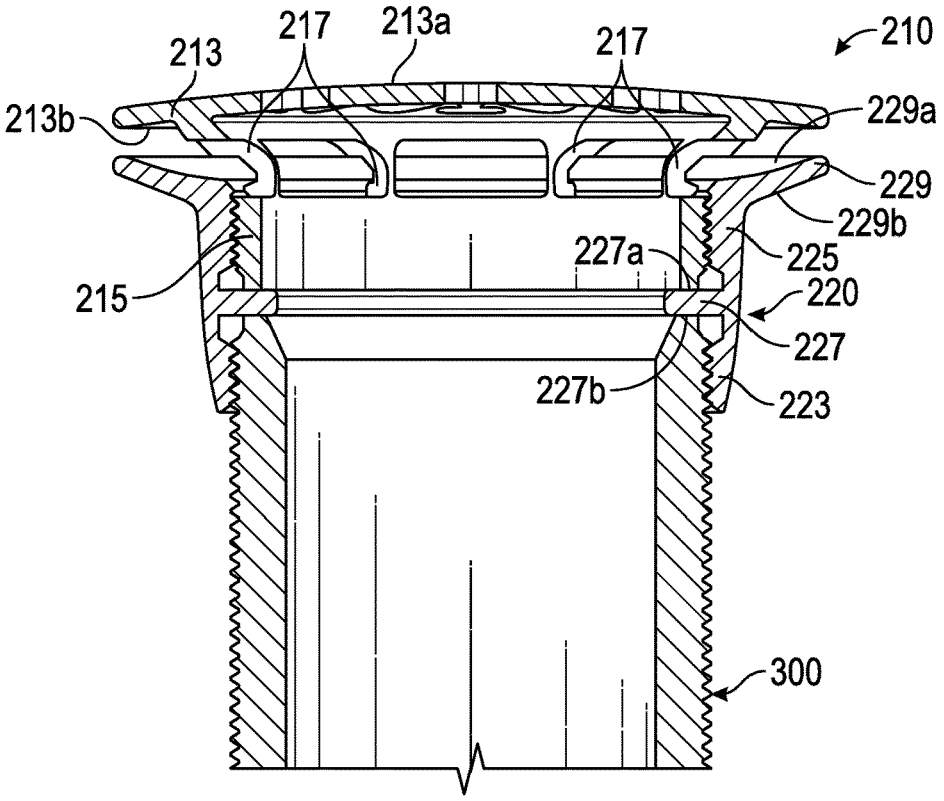
FIG. 3 is a cross-section view taken along line 3 in FIG. 2, according to an exemplary embodiment.

Referring to FIG. 3, the drain assembly 200 is shown coupled to the drain pipe 300, according to an exemplary embodiment. As shown in FIGS. 3 and 5, the receptor 220 has a generally hollow cylindrical shape. The receptor 220 includes a lower end 223 and an upper end 225. The receptor 220 is coupled to the drain pipe 300 at the lower end 223. The lower end 223 includes a threaded engagement surface engaged with corresponding threads disposed on an outer surface of the drain pipe 300. According to other exemplary embodiments, the lower end 223 is press-fit onto the drain pipe 300 (see, for example, FIG. 4). The receptor 220 further includes an inner flange 227. The inner flange 227 includes an upper engagement surface 227*a* and a lower engagement surface 227*b*. The receptor 220 is coupled to the drain pipe 300 such that the lower engagement surface 227*b* contacts at least a portion of the drain pipe 300. In this way, the inner flange 227 acts as a stop for regulating the position of the receptor 220 relative to the drain pipe 300.

As shown in FIGS. 3 and 5, the receptor 220 includes an outer flange 229 disposed at the upper end 225. The outer flange 229 includes an upper surface 229*a* and a lower surface 229*b*. The lower surface 229*b* is configured to contact a surface of the lavatory 100 when the receptor 220 couples the lavatory 100 to the drain pipe 300. In effect, the outer flange 229 sandwiches the lavatory 100 to the drain pipe 300 forming a multi-layered structure with a portion of the lavatory disposed between the receptor 220 and the drain pipe 300 (shown in FIGS. 2 and 7). The upper end 225 of the receptor 220 includes a threaded engagement surface configured to receive a portion of the cover 210.

According to various exemplary embodiments, the receptor 220 is made from a rigid or semi-rigid material, such as aluminum, brass, plastic, or other material suitable for the particular application of the receptor 220. The receptor 220 can be machined or formed by various molding techniques (e.g., injection molding, etc.).

Still referring to FIG. 3, the cover 210 is adjustably coupled to the receptor 220. The cover 210 includes a body 213 and a sleeve 215. The body 213 is connected to the sleeve 215 by a plurality of transition elements 217. Each of the transition elements 217 are arranged concentrically relative to the sleeve 215. The transition elements 217, the body 213 and the sleeve 215 collectively define a plurality of circumferential openings surrounding a portion of the cover 210. The sleeve 215 includes an outer engagement surface threadably engaged with the upper engagement surface of the receptor 220. The cover 210 is selectively adjustable relative to the receptor 220 via the threaded engagement between the sleeve 215 and the upper engagement surface 225*a*.

Figure 4:
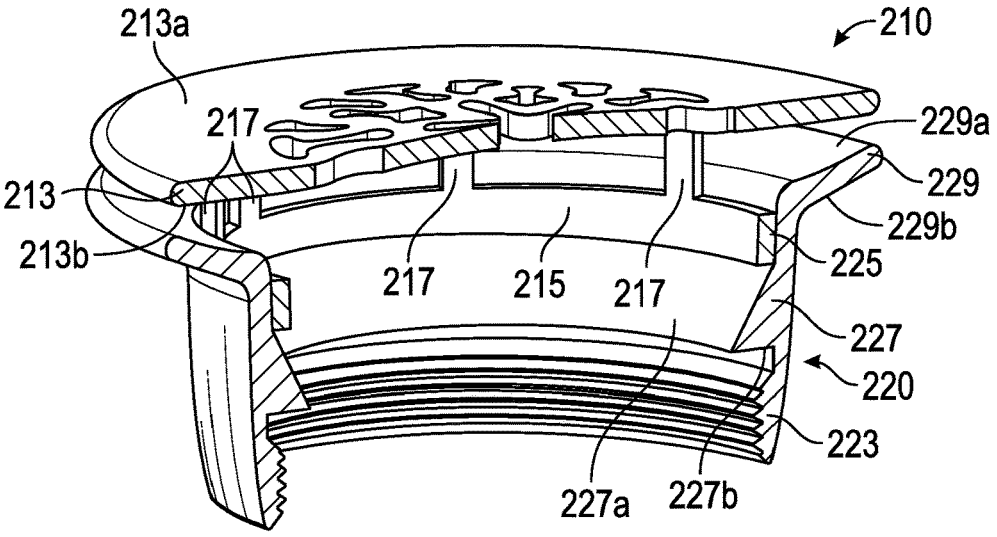
FIG. 4 is a perspective view of an adjustable drain assembly, according to an exemplary embodiment.
Figure 5:
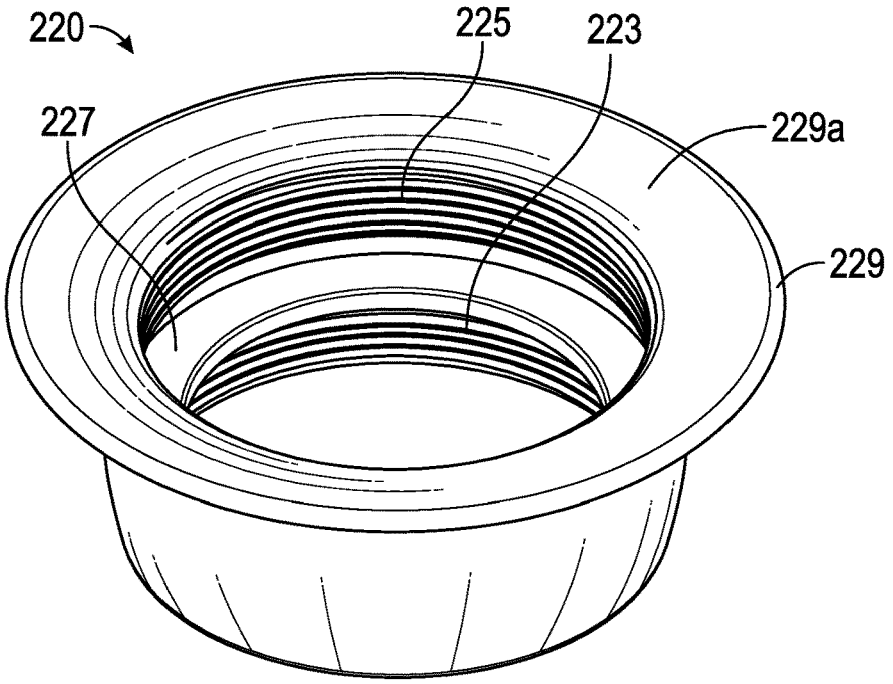
FIG. 5 is a perspective view of a receptor for the adjustable drain assembly of FIG. 2, according to an exemplary embodiment

According to an exemplary embodiment shown in FIG. 4, the sleeve 215 is press-fit relative to the upper engagement surface of the upper end 225. In the embodiment shown in FIG. 4, the upper end 225 does not include any threads. Instead, the upper end 225 includes a generally flat engagement surface in contact with the sleeve 215 such that there is an interference fit between the sleeve 215 and the upper end 225 of the receptor 220. In addition, the upper engagement surface 227*a* of the inner flange 227 tapers inward from the upper end 225 toward the center of the receptor 220.

According to various exemplary embodiments, the cover 210 is made from a rigid or semi-rigid material, such as aluminum, brass, plastic, or other materials or combinations of materials suitable for the particular application of the cover 210. The cover 210 can be machined or formed by various molding techniques (e.g., injection molding, etc.). The cover 210 can include various surface treatments or combinations of surface treatments, such as plating, different textures, paints/coatings, and the like.

Figure 6:
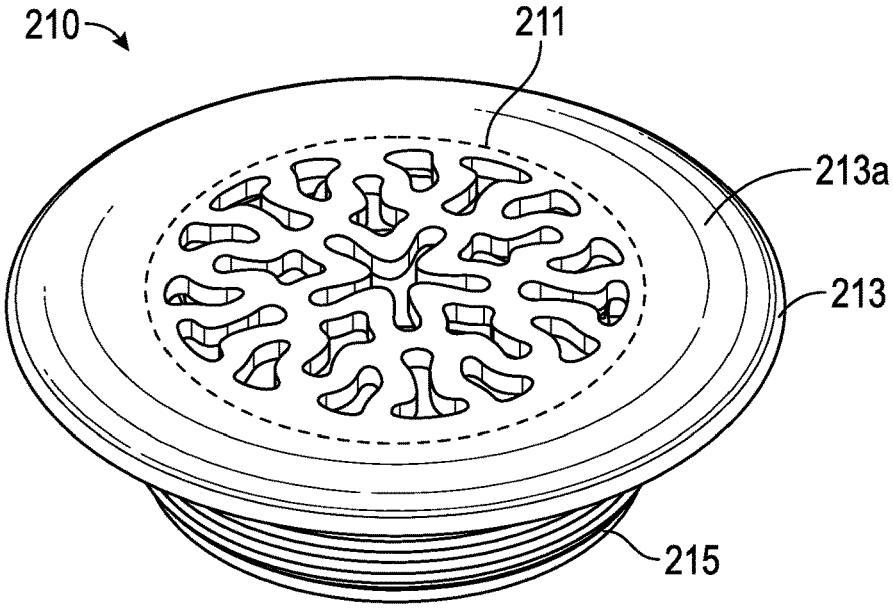
FIG. 6 is a perspective view of a cover for the adjustable drain assembly of FIG. 2, according to an exemplary embodiment.

Referring to FIGS. 3 and 6, the body 213 of the cover 210 includes a top surface 213*a* and a bottom surface 213*b*. The top surface 213*a* includes a drain opening design 211 (shown in FIG. 5) including at least one drain opening defining a first flow path for fluid to flow to/from the lavatory 100. The cover 210 is shown coupled to the receptor 220 such that a bottom edge of the sleeve 215 contacts the upper engagement surface 227*a* of the inner flange 227. In effect, the inner flange 227 acts as a stop for regulating the position of the cover 210 relative to the receptor 220 when the cover 210 is adjustably coupled to the receptor 220. According to an exemplary embodiment, the inner flange 227 of the receptor is positioned within the receptor 220 such that when the cover 210 is in contact with inner flange 227, there is a circumferential gap between the body 213 and the outer flange 229. More specifically, there is a circumferential gap formed between the bottom surface 213*a* of the body 213 and the upper surface 229*a* of the outer flange 229. According to other exemplary embodiments, the inner flange 227 may be located at a different position within the receptor 220 such that the body 213 is in contact with the outer flange 229 when the cover 210 engages the inner flange 227.

The circumferential gap between the body 213 and the outer flange 229, and the circumferential openings of the cover 210, collectively define the second flow path of the drain assembly 200. The second flow path can vary in size by selectively adjusting the cover 210 relative to the receptor 220, the details of which are discussed below. The opening in the body 213 defining the first flow path is fixed and is independent of the second flow path. In this way, the body 213 can have numerous design configurations. For example, referring to FIG. 5, the body 213 includes a patterned drain opening design 211, according to an exemplary embodiment. The drain opening design 211 includes a plurality of drain openings. According to other exemplary embodiments, the drain opening design 211 includes only one drain opening. In various exemplary embodiments, the size and the shape of the drain openings in the design 211 can vary significantly because the venting and draining requirements of the lavatory 100 are met by varying/adjusting the size of the second flow path. The shape of the outer surface 213*a* of the body 213 can also vary significantly depending on the particular application of the cover 210.

For example, in the embodiment shown in FIGS. 2-4 and 6, the outer surface 213*a* of the body 213 has a generally convex shape. According to another exemplary embodiment (not shown), the outer surface 213*a* has a generally planar shape. In other exemplary embodiments (not shown), the outer surface 213*a* has a generally concave shape. In the embodiment shown in FIGS. 2-3 and 5-6, the outer surface 213*a* is shaped such that when the cover 210 is coupled to the receptor 220 in the lavatory 100, the cover 210 has a seamless appearance with the lavatory. That is, the cover 210 has a size (e.g., outer diameter, etc.) sufficient to conceal the receptor 220 from the view of a user looking into the lavatory 100. This configuration is advantageous because it provides for better aesthetics of the lavatory 100.

Figure 7:
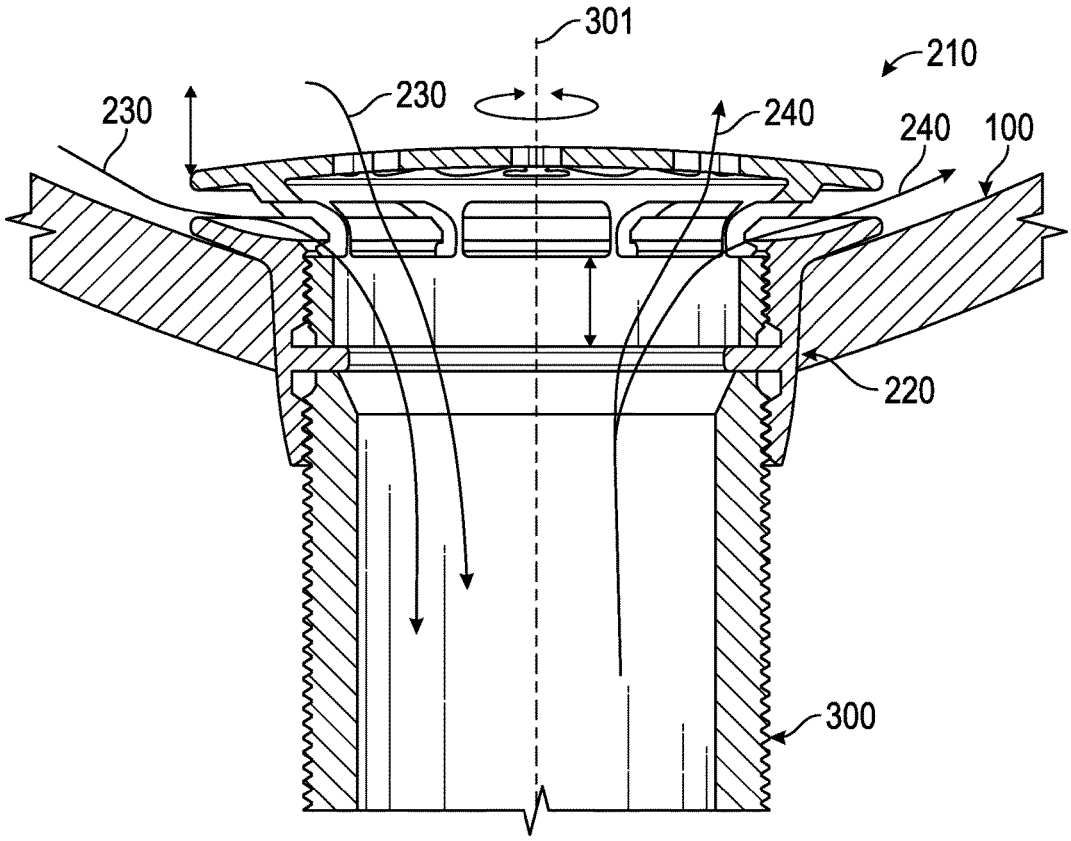
FIG. 7 is a cross-section view of a lavatory system including an adjustable drain assembly, according to an exemplary embodiment.

Referring to FIGS. 3 and 7, the cover 210 is adjustable relative to the receptor 220 to vary the size of the circumferential gap between the body 213 and the outer flange 229. Adjusting the size of the circumferential gap is desirable because a user can selectively increase or decrease the amount of fluid flowing to or from the lavatory 100 depending on the particular venting or draining requirements of the lavatory. According to an exemplary embodiment, the circumferential gap can be adjusted between about 0.100 inch and about 0.170 inch. According to other exemplary embodiments, the circumferential gap can be adjusted between about 0.100 inch and about 0.250 inch.

For example, if a user or installer would like to increase the venting/draining capabilities of the lavatory 100, the user or installer can simply rotate the cover 210 about a pivot axis 301 in a counter-clockwise fashion (or a clockwise fashion depending on the configuration of the threaded engagement surfaces) such that the relative distance between the bottom surface 213*a* of the body 213 and the upper surface 229*a* of the outer flange 229 increases (i.e., the circumferential gap). This in turn increases the size of the second flow path to allow for more fluid to flow between the lavatory 100 and the drain pipe 300. Likewise, if a user or installer wishes to decrease the venting/draining capabilities of the lavatory, the user or installer can rotate the cover 210 about the pivot axis 301 in a direction opposite to the direction for increasing the size of the second flow path.

According to the exemplary embodiment of FIG. 4, the relative distance between the bottom surface 213*a* and the upper surface 229*a* is selectively adjusted by inserting a spacer between the sleeve 215 and the upper end 225 of the receptor 220. Depending on the desired amount of adjustment, a user or installer can select a spacer having a size corresponding to the amount of adjustment. For example, if a user or installer determines that the size (e.g., height, etc.) of the second flow path needs to be increased by 1/32 inch, the user or installer can select a spacer having a size of 1/32 inch. The spacer can be inserted into the upper end 225 against a portion of the upper engagement surface. The cover 210 can then be coupled (e.g., press fit, etc.) to the upper end 225 with a portion of the cover 210 in contact with the spacer to regulate the relative distance between the cover 210 and the receptor 220.

According to the exemplary embodiment of FIG. 7, a flow of water 230 or other similar type of fluid is permitted to pass through at least a portion of the second flow path (i.e., the circumferential gap and the circumferential openings) to the drain pipe 300 to allow for draining of the lavatory 100. An air flow 240 that is present or trapped in the drain pipe 300 is permitted to pass up through the drain pipe 300 through at least a portion of the first flow path and at least a portion of the second flow path to ambient, to allow for venting of the drain pipe 300. By selectively adjusting the relative size of the second flow path, a user or installer can tailor the drain assembly to increase or decrease the amount of fluid flowing between the lavatory 100 and the drain pipe 300, depending on the specific draining/venting requirements of the lavatory.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. An adjustable lavatory drain assembly, comprising:

a receptor including an inner threaded engagement surface configured to couple the receptor to a drain pipe; and a cover removably coupled to the receptor to define a circumferential gap therebetween, wherein the cover includes one or more openings that define a first flow path and the circumferential gap defines at least part of a second flow path;

wherein the cover is configured to be selectively adjusted relative to the receptor to increase or decrease the circumferential gap; and wherein the receptor includes an inner flange extending radially inward within the receptor and configured to act as a stop for limiting a position of the receptor relative to a drain pipe and a position of the cover relative to the receptor.

2. The assembly of claim 1, wherein the receptor includes an outer flange extending radially outward away from an upper portion of the receptor.

3. The assembly of claim 1, wherein the cover comprises:

a body including the one or more openings disposed therein;

a sleeve extending from the body and configured to couple the cover to the receptor; and a plurality of transition elements connecting the body to the sleeve;

wherein the plurality of transition elements are arranged to define a plurality of circumferential openings between the body and the sleeve; and wherein the plurality of circumferential openings and the circumferential gap collectively define the second flow path.

4. The assembly of claim 1, wherein the inner flange includes an upper engagement surface and a lower engagement surface.

5. The assembly of claim 4, wherein the cover is configured to contact the upper engagement surface of the inner flange when the cover is coupled to the receptor, and wherein the lower engagement surface is configured to contact a portion of a drain pipe when the receptor is coupled to the drain pipe.

6. The assembly of claim 1, wherein the cover is threadably coupled to the receptor.

7. The assembly of claim 1, wherein the cover is press-fit in the receptor.

8. The assembly of claim 1, further comprising a spacer disposed between the cover and the receptor to set a position of the cover relative to the receptor.

9. The assembly of claim 1, wherein the cover includes an upper surface having a convex shape.

10. A lavatory assembly, comprising:

a ventless lavatory; and a drain assembly configured to couple the ventless lavatory to a drain pipe, the drain assembly comprising:

a receptor including an inner threaded engagement surface configured to couple the receptor to the drain pipe; and a cover adjustably coupled to the receptor, wherein the cover includes one or more openings that define a first flow path;

wherein the receptor is configured to be removably coupled to the drain pipe and to engage the ventless lavatory;

wherein the cover is configured to be selectively adjusted relative to the receptor to define a gap having a variable size;

wherein the gap defines part of a second flow path; and wherein the receptor includes an inner flange extending radially within the receptor and configured to act as a stop for limiting a position of the receptor relative to a drain pipe and a position of the cover relative to the receptor, and wherein the inner flange includes an upper engagement surface and a lower engagement surface.

11. The assembly of claim 10, wherein the first and second flow paths are each configured to:

direct a flow of water from the ventless lavatory to the drain pipe, and direct a flow of air from the drain pipe to ambient.

12. The assembly of claim 10, wherein the receptor includes an outer flange extending radially outward away from an upper portion of the receptor.

13. The assembly of claim 12, wherein the cover substantially conceals the outer flange of the receptor from view.

14. The assembly of claim 10, wherein the cover comprises:

a body including the one or more openings disposed therein;

a sleeve extending from the body and configured to couple the cover to the receptor; and a plurality of transition elements connecting the body to the sleeve;

wherein the plurality of transition elements are arranged to define a plurality of circumferential openings between the body and the sleeve; and wherein the plurality of circumferential openings and the gap collectively define the second flow path.

15. The assembly of claim 10, wherein the cover is configured to contact the upper engagement surface of the inner flange when the cover is coupled to the receptor, and wherein the lower engagement surface is configured to contact a portion of the drain pipe when the receptor is coupled to the drain pipe.

16. An adjustable drain assembly for a lavatory, comprising:

a receptor including an inner threaded engagement surface configured to removably couple a lavatory to a drain pipe; and a cover adjustably coupled to the receptor, the cover including an opening defining a first flow path;

wherein a portion of the cover and a portion of the receptor cooperatively define a second flow path;

wherein the cover is configured to be moved relative to the receptor to selectively increase or decrease a size of the second flow path; and wherein the receptor includes an inner flange extending radially inward toward a center of the receptor and configured to act as a stop for limiting a position of the receptor relative to the drain pipe and a position of the cover relative to the receptor.

17. The assembly of claim 16, wherein the first and second flow paths are each configured to:

direct a flow of water from the lavatory to the drain pipe, and direct a flow of air from the drain pipe to ambient.

18. The assembly of claim 16, wherein the cover includes a plurality of circumferential openings which define part of the second flow path.

19. The assembly of claim 16, wherein the cover is threadably coupled to the receptor, and wherein the cover is configured to be rotated relative to the receptor to selectively increase or decrease the size of the second flow path.

* * * * *